US006096464A

United States Patent [19]

Sundararajan et al.

[11] Patent Number: 6,096,464

[45] Date of Patent: Aug. 1, 2000

[54] PHOTORECEPTOR INCLUDING ROTAXANES

[75] Inventors: Pudupadi R. Sundararajan, Oakville; Dasarao K. Murti, Mississauga; Peter G. Odell, Mississauga; Gordon K. Hamer, Mississauga, all of Canada

[73] Assignee: Xerox Corporation, Stamford, Conn.

[21] Appl. No.: 09/492,098

[22] Filed: Jan. 27, 2000

[51] Int. Cl.[7] ..... G03G 15/02

[52] U.S. Cl. ..... 430/58.05

[58] Field of Search ..... 430/56, 58.05, 430/58.65, 66, 67; 252/500

[56] References Cited

U.S. PATENT DOCUMENTS

| | | | |
|---|---|---|---|
| 5,521,041 | 5/1996 | Miyamoto et al. | 430/96 |
| 5,538,655 | 7/1996 | Fauteux et al. | 252/62.2 |
| 5,665,501 | 9/1997 | Derks et al. | 430/96 |
| 5,798,197 | 8/1998 | Paulus et al. | 430/56 |
| 5,876,887 | 3/1999 | Chambers et al. | 430/78 |
| 5,945,502 | 8/1999 | Hsieh et al. | 528/101 |
| 5,952,145 | 8/1998 | Yamanaka et al. | 430/110 |

OTHER PUBLICATIONS

P. R. Sundararajan, "Possible Helical Shapes of the Polycarbonate Chain and Their Influence on the Unperturbed Dimensions," *Macromolecules*, vol. 20, pp. 1534–1539 (1987).

Daniel Brunelle et al., "Preparation and Polymerization of Cyclic Oligomeric Carbonates: New Route to Super–High Molecular Weight Polycarbonate: An Overview," *Polym. Preprints*, vol. 30 (2), pp. 569–570 (1989).

Daniel Brunelle et al., "Studies on the Mechanism of Amine–Catalyzed Cyclic Oligomeric Carbonate Formation," *Makromol. Chem., Macromol. Symp.*, vol. 54/55, pp. 397–412 (1992).

Harry W. Gibson et al., "Polyrotaxanes: Molecular Composites Derived by Physical Linkage of Cyclic and Linear Species," *Advanced Materials*, vol. 5, No. 1, pp. 11–21 (1993).

Yu. S. Lipatov et al., "Synthesis and Structure of Macromolecular Topological Compounds," *Advances in Polymer Science*, vol. 88, pp. 49–76 (1989).

Gerhard Wenz, "Cyclodextrins as Building Blocks for Supramolecular Structures and Functional Units," *Angew. Chem. Int. Ed. Engl.*, vol. 33, pp. 803–822 (1994).

L. Garrido et al., "Studies of cyclic and linear poly(dimethylsiloxanes): 15. Diffusion coefficients from network sorption measurements," *Polymer Communications*, vol. 25, pp. 218–220 (1984).

L. Garrido et al., "Studies of Cyclic and Linear Poly(dimethylsiloxane): 16. Trapping of Cyclics Present During the End Linking of Linear Chains into Network Structures," *Polymer Communications*, vol. 26, pp. 53–55 (Feb. 1985).

S.J. Clarson et al., "Studies of cyclic and linear poly(dimethylsiloxanes): Effect of ring size on the trapping of cyclic polymers into network structures," *Polymer Communications*, vol. 27, pp. 244–245 (1986).

S.J. Clarson, "Studies of Cyclic and Linear Poly(dimethylsiloxanes): 24. Topological Trapping of Cyclic Polymers into Unimodal and Bimodal Model Network Structures," *Polymer Communications*, vol. 28, pp. 151–153 (May 1987).

*Primary Examiner*—Roland Martin
*Attorney, Agent, or Firm*—Zosan S. Soong

[57] ABSTRACT

A photoreceptor including: (a) a substrate; (b) a charge generating layer; and (c) a charge transport layer including a charge transport material and a rotaxane material.

12 Claims, 1 Drawing Sheet

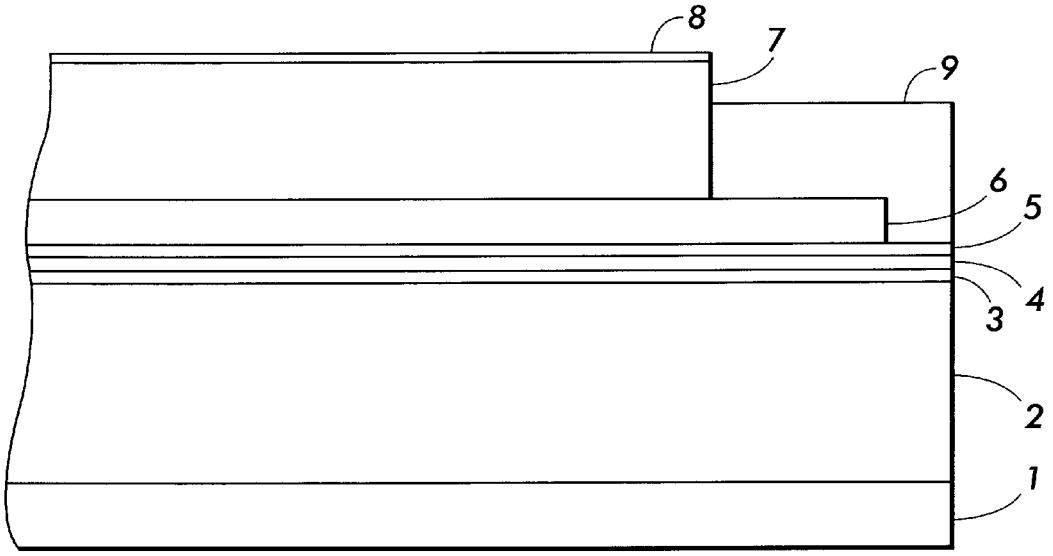
8
7
9
6
5
4
3
2
1

PHOTORECEPTOR INCLUDING ROTAXANES

FIELD OF THE INVENTION

This invention relates to a photoreceptor.

BACKGROUND OF THE INVENTION

It is known that certain polymers form cyclic fractions during the synthesis. This is made possible by the steric flexibility and the geometrical shape of the repeat units. Poly(dimethyl siloxane) is a classic example in which cyclics occur during synthesis and can be isolated. Molecular simulations showed that polycarbonates, e.g., PC(A), PC(Z), PC(P), all have geometrical shape and stereochemical facility to form cyclics, ranging from 3 to 15 repeat units. (P. R. Sundararajan, "Possible Helical Shapes of the Polycarbonate Chain and Their Influence on the Unperturbed Dimensions," *Macromolecules*, Vol. 20, pp. 1534–1539 (1987)). Brunelle et al., have reported synthesis of cyclic polycarbonates, with 2–21 units (Daniel Brunelle et al., "Preparation and Polymerization of Cyclic Oligomeric Carbonates: New Route to Super-High Molecular Weight Polycarbonate: An Overview," *Polym. Preprints*, Vol. 30 (2), pp. 569–570 (1989); Daniel Brunelle et al., "Studies on the Mechanism of Amine-Catalyzed Cyclic Oligomeric Carbonate Formation," *Makromol. Chem., Macromol.* Symp., Vol. 54/55, pp. 397–412 (1992)).

Threading linear molecules into cyclic molecules to form rotaxanes has been explored as reflected in the following documents:

Harry W. Gibson et al., "Polyrotaxanes: Molecular Composites Derived by Physical Linkage of Cyclic and Linear Species," *Advanced Materials*, Vol. 5, No. 1, pp. 11–21 (1993);

Yu. S. Lipatov et al., "Synthesis and Structure of Macromolecular Topological Compounds," *Advances in Polymer Science*, Vol. 88, pp. 49–76 (1989);

Gerhard Wenz, "Cyclodextrins as Building Blocks for Supramolecular Structures and Functional Units," *Angew. Chem. Int. Ed. Engl.*, Vol. 33, pp. 803–822 (1994);

L. Garrido et al., "Studies of cyclic and linear poly (dimethylsiloxanes): 15. Diffusion coefficients from network sorption measurements," *Polymer Communications*, Vol. 25, pp. 218–220 (1984);

L. Garrido et al., "Studies of Cyclic and Linear Poly (dimethylsiloxane): 16. Trapping of Cyclics Present During the End Linking of Linear Chains into Network Structures," *Polymer Communications*, Vol. 26, pp. 53–55 (February 1985);

S. J. Clarson et al., "Studies of cyclic and linear poly (dimethylsiloxaners): Effect of ring size on the trapping of cyclic polymers into network structures," *Polymer Communications*, Vol. 27, pp. 244–245 (1986);

S. J. Clarson, "Studies of Cyclic and Linear Poly (dimethylsiloxanes): 24. Topological Trapping of Cyclic Polymers into Unimodal and Bimodal Model Network Structures," *Polymer Communications*, Vol. 28, pp. 151–153 (May 1987); and Fauteux et al., U.S. Pat. No. 5,538,655, having the title "Molecular Complexes for Use as Electrolyte Components."

The top surface and the bottom surface of a moving web or belt type photoreceptors may be in contact with backer bars and back cleaners inside the xerographic printing machine. Such contact abrades the surfaces of the photoreceptor and may eventually wear away enough of the photoreceptor to impair its function. Another source of wear of the top surface of a photoreceptor comes from electrochemical reaction of the corona charging devices. Abrasion resistant materials are desirable for the top and bottom surfaces of the photoreceptor to prolong its life. The present invention addresses the problem of abrasion of the photoreceptor by providing new materials with enhanced abrasion resistance for the anticurl layer, the charge transport layer, and the overcoating layer, particularly in those embodiments where there is absent an overcoating layer over the charge transport layer.

Conventional photoreceptors are disclosed in Chambers et al., U.S. Pat. No. 5,876,887; Miyamoto et al., U.S. Pat. No. 5,521,041; and Derks et al., U.S. Pat. No. 5,665,501.

SUMMARY OF THE INVENTION

The present invention is accomplished in embodiments by providing a composition including a charge transport material and a rotaxane material.

In other embodiments of the present invention, there is provided a photoreceptor comprising:

(a) a substrate;

(b) a charge generating layer; and (c) a charge transport layer including a charge transport material and a rotaxane material.

There is also provided in embodiments of the present invention a photoreceptor comprising:

(a) an anti-curl layer including a rotaxane material;

(b) a substrate; and (c) an imaging layer.

There is further provided in embodiments of the present invention a photoreceptor comprising:

(a) a substrate;

(b) an imaging layer; and (c) an overcoating layer including a rotaxane material.

BRIEF DESCRIPTION OF THE DRAWINGS

The FIGURE is a cross-sectional view of one embodiment of the present multi-layer photoreceptor.

DETAILED DESCRIPTION

A representative structure of an electrophotographic imaging member (also referred herein as "photoreceptor") is shown in the FIGURE. This imaging member is provided with an anti-curl layer 1, a supporting substrate 2, an electrically conductive ground plane 3, a charge blocking layer 4, an adhesive layer 5, a charge generating layer 6, a charge transport layer 7, an overcoating layer 8, and a ground strip 9.

The Anti-Curl Layer

For some applications, an optional anti-curl layer 1 can be provided, which comprises film-forming organic or inorganic polymers that are electrically insulating or slightly semi-conductive. The anti-curl layer provides flatness and/or abrasion resistance.

Anti-curl layer 1 can be formed at the back side of the substrate 2, opposite the imaging layers. The anti-curl layer may include, in addition to the film-forming resin, an adhesion promoter polyester additive. Examples of film-forming resins useful as the anti-curl layer include, but are not limited to, polyacrylate, polystyrene, poly(4, 4'isopropylidene diphenylcarbonate), poly(4,4'-cyclohexylidene diphenylcarbonate, mixtures thereof and the like.

Additives may be present in the anti-curl layer in the range of about 0.5 to about 40 weight percent of the anti-curl layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

Typical adhesion promoters useful as additives include, but are not limited to, duPont 49,000 (duPont), Vitel PE-100, Vitel PE-200, Vitel PE-307 (Goodyear), mixtures thereof and the like. Usually from about 1 to about 15 weight percent adhesion promoter is selected for film-forming resin addition, based on the weight of the film-forming resin.

In embodiments, the anti-curl layer includes a rotaxane material. The rotaxane material is present in an amount ranging for example from about 60% to about 100% by weight based on the weight of the anti-curl layer, the balance being other materials such as additives described herein. The rotaxane material useful for the anti-curl layer is described in more detail in the section pertaining to the charge transport layer. Unless otherwise noted, the description of the rotaxane material and its use for the charge transport layer is equally applicable for the use of the rotaxane material in the anti-curl layer.

The thickness of the anti-curl layer is typically from about 3 micrometers to about 35 micrometers and, preferably, about 14 micrometers. However, thicknesses outside these ranges can be used.

The anti-curl coating can be applied as a solution prepared by dissolving the film-forming resin and the adhesion promoter in a solvent such as methylene chloride. The solution may be applied to the rear surface of the supporting substrate (the side opposite the imaging layers) of the photoreceptor device, for example, by web coating or by other methods known in the art. Coating of the overcoat layer and the anti-curl layer can be accomplished simultaneously by web coating onto a mulilayer photoreceptor comprising a charge transport layer, charge generation layer, adhesive layer, blocking layer, ground plane and substrate. The wet film coating is then dried to produce the anti-curl layer 1.

The Supporting Substrate

As indicated above, the photoreceptors are prepared by first providing a substrate 2, i.e., a support. The substrate can be opaque or substantially transparent and can comprise any of numerous suitable materials having given required mechanical properties.

The substrate can comprise a layer of electrically non-conductive material or a layer of electrically conductive material, such as an inorganic or organic composition. If a non-conductive material is employed, it is necessary to provide an electrically conductive ground plane over such non-conductive material. If a conductive material is used as the substrate, a separate ground plane layer may not be necessary.

The substrate can be flexible or rigid and can have any of a number of different configurations, such as, for example, a sheet, a cylinder, a scroll, an endless flexible belt, a web, and the like. The photoreceptor may be coated on a rigid, opaque, conducting substrate, such as an aluminum drum.

Various resins can be used as electrically non-conducting materials, including, but not limited to, polyesters, polycarbonates, polyamides, polyurethanes, and the like. Such a substrate preferably comprises a commercially available biaxially oriented polyester known as MYLAR™, available from E. I. duPont de Nemours & Co., MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E. I. duPont de Nemours & Co., polyethylene and polypropylene, available as MARLEX™ from Phillips Petroleum Company, polyphenylene sulfide, RYTON™ available from Phillips Petroleum Company, and polyimides, available as KAPTON™ from E. I. duPont de Nemours & Co. The photoreceptor can also be coated on an insulating plastic drum, provided a conducting ground plane has previously been coated on its surface, as described above. Such substrates can either be seamed or seamless.

When a conductive substrate is employed, any suitable conductive material can be used. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, suicides, quaternary ammonium salt compositions, conductive polymers such as polyacetylene or its pyrolysis and molecular doped products, charge transfer complexes, and polyphenyl silane and molecular doped products from polyphenyl silane. A conducting plastic drum can be used, as well as the preferred conducting metal drum made from a material such as aluminum.

The preferred thickness of the substrate depends on numerous factors, including the required mechanical performance and economic considerations. The thickness of the substrate is typically within a range of from about 65 micrometers to about 150 micrometers, and preferably is from about 75 micrometers to about 125 micrometers for optimum flexibility and minimum induced surface bending stress when cycled around small diameter rollers, e.g., 19 mm diameter rollers. The substrate for a flexible belt can be of substantial thickness, for example, over 200 micrometers, or of minimum thickness, for example, less than 50 micrometers, provided there are no adverse effects on the final photoconductive device. Where the preferred aluminum drum is used, the thickness should be sufficient to provide the necessary rigidity. This is usually about 1–6mm.

The surface of the substrate to which a layer is to be applied is preferably cleaned to promote greater adhesion of such a layer. Cleaning can be effected, for example, by exposing the surface of the substrate layer to plasma discharge, ion bombardment, and the like. Other methods, such as solvent cleaning, can be used.

Regardless of any technique employed to form a metal layer, a thin layer of metal oxide generally forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

The Electrically Conductive Ground Plane

As stated above, photoreceptors prepared in accordance with the present invention comprise a substrate that is either electrically conductive or electrically non-conductive. When a non-conductive substrate is employed, an electrically conductive ground plane 3 must be employed, and the ground plane acts as the conductive layer. When a conductive substrate is employed, the substrate can act as the conductive layer, although a conductive ground plane may also be provided.

If an electrically conductive ground plane is used, it is positioned over the substrate. Suitable materials for the electrically conductive ground plane include, but are not limited to, aluminum, zirconium, niobium, tantalum, vanadium, hafnium, titanium, nickel, stainless steel, chromium, tungsten, molybdenum, copper, and the like, and mixtures and alloys thereof. In embodiments, aluminum, titanium, and zirconium are preferred.

The ground plane can be applied by known coating techniques, such as solution coating, vapor deposition, and sputtering. A preferred method of applying an electrically conductive ground plane is by vacuum deposition. Other suitable methods can also be used.

Preferred thicknesses of the ground plane are within a substantially wide range, depending on the optical transparency and flexibility desired for the electrophotoconductive member. Accordingly, for a flexible photoresponsive imaging device, the thickness of the conductive layer is preferably between about 20 angstroms and about 750 angstroms; more preferably, from about 50 angstroms to about 200 angstroms for an optimum combination of electrical conductivity, flexibility, and light transmission. However, the ground plane can, if desired, be opaque.

The Charge Blocking Layer

After deposition of any electrically conductive ground plane layer, a charge blocking layer 4 can be applied thereto. Electron blocking layers for positively charged photoreceptors permit holes from the imaging surface of the photoreceptor to migrate toward the conductive layer. For negatively charged photoreceptors, any suitable hole blocking layer capable of forming a barrier to prevent hole injection from the conductive layer to the opposite photoconductive layer can be utilized.

If a blocking layer is employed, it is preferably positioned over the electrically conductive layer. The term "over," as used herein in connection with many different types of layers, should be understood as not being limited to instances wherein the layers are contiguous. Rather, the term refers to relative placement of the layers and encompasses the inclusion of unspecified intermediate layers.

The blocking layer 4 can include polymers, such as polyvinyl butyral, epoxy resins, polyesters, polysiloxanes, polyamides, polyurethanes, and the like; nitrogen-containing siloxanes or nitrogen-containing titanium compounds, such as trimethoxysilyl propyl ethylene diamine, N-beta(aminoethyl) gamma-aminopropyl trimethoxy silane, isopropyl 4-aminobenzene sulfonyl titanate, di(dodecylbenezene sulfonyl) titanate, isopropyl di(4-arninobenzoyl)isostearoyl titanate, isopropyl tri(N-ethyl amino) titanate, isopropyl trianthranil titanate, isopropyl tri(N,N-dimethyl-ethyl amino) titanate, titanium-4-amino benzene sulfonate oxyacetate, titanium 4-aminobenzoate isostearate oxyacetate, gamma-aminobutyl methyl dimethoxy silane, gamma-aminopropyl methyl dimethoxy silane, and gamma-aminopropyl trimethoxy silane, as disclosed in U.S. Pat. Nos. 4,338,387, 4,286,033, and 4,291,110.

A preferred hole blocking layer comprises a reaction product of a hydrolyzed silane or a mixture of hydrolyzed silanes and the oxidized surface of a metal ground plane layer. The oxidized surface inherently forms on the outer surface of most metal ground plane layers when exposed to air after deposition. This combination enhances electrical stability at low relative humidity. The hydrolyzed silanes can then be used as is well known in the art. For example, see U.S. Pat. No. 5,091,278 to Teuscher et al.

The blocking layer 4 should be continuous and can have a thickness of up to 2 micrometers depending on the type of material used.

However, the blocking layer preferably has a thickness of less than about 0.5 micrometer because greater thicknesses may lead to undesirably high residual voltage. A blocking layer between about 0.005 micrometer and about 0.3 micrometer is satisfactory for most applications because charge neutralization after the exposure step is facilitated and good electrical performance is achieved. A thickness between about 0.03 micrometer and about 0.06 micrometer is preferred for blocking layers for optimum electrical behavior.

The blocking layer 4 can be applied by any suitable technique, such as spraying, dip coating, draw bar coating, gravure coating, silk screening, air knife coating, reverse roll coating, vacuum deposition, chemical treatment, and the like. For convenience in obtaining thin layers, the blocking layer is preferably applied in the form of a dilute solution, with the solvent being removed after deposition of the coating by conventional techniques, such as by vacuum, heating, and the like. Generally, a weight ratio of blocking layer material and solvent of between about 0.5:100 to about 5.0:100 is satisfactory for spray coating.

The Adhesive Layer

An intermediate layer 5 between the blocking layer and the charge generating layer may, if desired, be provided to promote adhesion. However, in the present invention, a dip coated aluminum drum may be utilized without an adhesive layer.

Additionally, adhesive layers can be provided, if necessary, between any of the layers in the photoreceptors to ensure adhesion of any adjacent layers. Alternatively, or in addition, adhesive material can be incorporated into one or both of the respective layers to be adhered. Such optional adhesive layers preferably have thicknesses of about 0.001 micrometer to about 0.2 micrometer. Such an adhesive layer can be applied, for example, by dissolving adhesive material in an appropriate solvent, applying by hand, spraying, dip coating, draw bar coating, gravure coating, silk screening, air knife coating, vacuum deposition, chemical treatment, roll coating, wire wound rod coating, and the like, and drying to remove the solvent. Suitable adhesives include, for example, film-formning polymers, such as polyester, dupont 49,000 (available from E. I. duPont de Nemours & Co.), Vitel PE-100 (available from Goodyear Tire and Rubber Co.), polyvinyl butyral, polyvinyl pyrrolidone, polyurethane, polymethyl methacrylate, and the like.

The Imaging Layer(s)

In fabricating a photosensitive imaging member, a charge generating material (CGM) and a charge transport material (CTM) may be deposited onto the substrate surface either in a laminate type configuration where the CGM and CTM are in different layers or in a single layer configuration where the CGM and CTM are in the same layer along with a binder resin. The photoreceptors embodying the present invention can be prepared by applying over the electrically conductive layer the charge generation layer 6 and a charge transport layer 7. In embodiments, the charge generation layer and the charge transport layer may be applied in either order.

Illustrative organic photoconductive charge generating materials include azo pigments such as Sudan Red, Dian Blue, Janus Green B, and the like; quinone pigments such as Algol Yellow, Pyrene Quinone, Indanthrene Brilliant Violet RRP, and the like; quinocyanine pigments; perylene pigments; indigo pigments such as indigo, thioindigo, and the like; bisbenzoimidazole pigments such as Indofast Orange toner, and the like; phthalocyanine pigments such as copper phthalocyanine, aluminochloro-phthalocyanine, and the like; quinacridone pigments; or azulene compounds. Suitable inorganic photoconductive charge generating materials include for example cadium sulfide, cadmium sulfoselenide, cadmium selenide, crystalline and amorphous selenium, lead oxide and other chalcogenides. Alloys of selenium are encompassed by embodiments of the instant invention and include for instance selenium-arsenic, selenium-tellurium-arsenic, and selenium-tellurium.

Any suitable inactive resin binder material may be employed in the charge generating layer. Typical organic resinous binders include polycarbonates, acrylate polymers, methacrylate polymers, vinyl polymers, cellulose polymers, polyesters, polysiloxanes, polyamides, polyurethanes, epoxies, polyvinylacetals, and the like.

Charge transport materials include an organic polymer or non-polymeric material capable of supporting the injection of photoexcited holes or transporting electrons from the photoconductive material and allowing the transport of these holes or electrons through the organic layer to selectively dissipate a surface charge. Illustrative charge transport materials include for example a positive hole transporting material selected from compounds having in the main chain or the side chain a polycyclic aromatic ring such as anthracene, pyrene, phenanthrene, coronene, and the like, or a nitrogen-containing hetero ring such as indole, carbazole, oxazole, isoxazole, thiazole, imidazole, pyrazole, oxadiazole, pyrazoline, thiadiazole, triazole, and hydrazone compounds. Typical hole transport materials include electron donor materials, such as carbazole; N-ethyl carbazole; N-isopropyl carbazole; N-phenyl carbazole; tetraphenylpyrene; 1-methyl pyrene; perylene; chrysene; anthracene; tetraphene; 2-phenyl naphthalene; azopyrene; 1-ethyl pyrene; acetyl pyrene; 2,3-benzochrysene; 2,4-benzopyrene; 1,4-bromopyrene; poly (N-vinylcarbazole); poly(vinylpyrene); poly(-vinyltetraphene); poly(vinyltetracene) and poly (vinylperylene). Suitable electron transport materials include electron acceptors such as 2,4,7-trinitro-9-fluorenone; 2,4,5,7-tetranitro-fluorenone; dinitroanthracene; dinitroacridene; tetracyanopyrene and dinitroanthraquinone.

Preferred charge transport materials are aryl amines including N,N'-diphenyl-N,N'-bis(alkylphenyl)-(1,1-biphenyl)-4,4'-diamine wherein alkyl is selected from the group consisting of methyl, ethyl, propyl, butyl, hexyl, and the like; and N,N'-diphenyl-N,N'-bis(halophenyl)-(1,1'-biphenyl)-4,4'-diamine wherein the halo substituent is preferably a chloro substituent. Other known charge transport layer molecules can be selected, reference for example U.S. Pat. Nos. 4,921,773 and 4,464,450, the disclosures of which are totally incorporated herein by reference.

The rotaxane material may be considered a binder for the charge transport material. The rotaxane material includes cyclic molecules, linear molecules threaded through the cyclic molecules, and optionally bulky end groups on the linear molecules to prevent loss of the cyclic molecules by dethreading. The rotaxane material may be composed entirely of one type of rotaxane, but the rotaxane material may be a mixture of two or more different rotaxanes. Any suitable rotaxane material may be employed including those described in Harry W. Gibson et al., "Polyrotaxanes: Molecular Composites Derived by Physical Linkage of Cyclic and Linear Species," *Advanced Materials*, Vol. 5, No. 1, pp. 11–21 (1993), the disclosure of which being totally incorporated herein by reference. For example, the rotaxane may be a homorotaxane or a heterorotaxane. The rotaxane may be selected from any of the subclasses of rotaxanes, including for instance from the subclasses of a main chain rotaxane and a side chain rotaxane.

Any suitable cyclic molecules may be employed for the rotaxane material such as for example a cyclic polycarbonate, a crown ether, a cyclodextrin, and a cyclic polyester.

Regarding suitable cyclic polycarbonates, illustrative examples of bisphenols forming the units of the cyclic polycarbonate oligomers are 4,4'-isopropylidenebisphenol, 4,4'-cyclohexylidenebisphenol, 4,4'-(1,4-phenylenebisisopropylidene)bisphenol, and 4,4'-hexafluoroisopropylidenebisphenol.

The crown ether may be for example (the nomenclature M-Crown-N refers to a crown ether with M number of atoms, of which N is the number of oxygen atoms) 30-Crown-10, 36-Crown-12, 42-Crown-14, 48-Crown-1 6, or 60-Crown-20. It may also be bis(p-phenylene)-34-Crown-10, as described in Harry W. Gibson et al., "Polyrotaxanes: Molecular Composites Derived by Physical Linkage of Cyclic and Linear Species," *Advanced Materials*, Vol. 5, No. 1, pp. 11–21 (1993), the disclosure of which being totally incorporated herein by reference.

The cyclodextrine may be for example alpha-cyclodextrin, beta-cyclodextrin, and gamma-cyclodextrin, containing 6, 7, and 8 alpha-D-glucose units, respectively, in the cycle.

The cyclic polyester may be for example a cyclic trimer or cyclic tetramer of poly(ethylene terephthalate) or poly (butylene terephthalate).

The phrase "linear molecules" refers to any suitable molecules, whether branched or unbranched, that are capable of threading the cyclic molecules to form the rotaxane material. The linear molecules are generally in the form of chains that are preferably unbranched. Branching of the linear molecules may occur, but preferably not to the extent that the branching significantly interferes with the formation of the rotaxane material.

Any suitable linear molecules may be employed for the rotaxane material including a homopolymer selected from the illustrative group of a linear polycarbonate, a polyamide, a polyurethane, a polyimide, and a polyester.

Using a source based nomenclature, the linear polycarbonate may be for example poly(4,4'-isopropylidenebisphenol)carbonate; poly(4,4'-(3-methylbisphenol) carbonate; poly(4,4'-(1,4-phenylenebisisopropylidenebisphenol)carbonate; and poly (4,4'-cyclohexylidenebisphenol)carbonate.

The polyamide may be for example poly(imino(1-oxohexamethylene)) (also known as polyamide 6), poly (iminoadipoyl-iminohexamethylene) (also known as polyamide 66), poly(iminohexamethylene-iminosebacoyl) (also known as polyamide 610), poly(imino (1-oxododecamethylene)) (also known as polyamide 12) or any of the suitable polyamides selected from the list contained in Polymer Handbook, Fourth Edition, J. Brandrup, E. H. Immergut, and E. A. Grulke, Editors, John Wiley & Sons, 1999, pp. 235–238, the disclosure of which is totally incorporated herein by reference.

The polyurethane may be for example polyurethane of tetra(ethylene glycol) and 4,4'-methylenebis(p-phenyl isocyanate) or any of the suitable polyurethanes selected from the list contained in Polymer Handbook, Fourth Edition, J. Brandrup, E. H. Immergut, and E. A. Grulke, Editors, John Wiley & Sons, 1999, pp. 229–231, the disclosure of which is totally incorporated herein by reference. Suitable polyurethanes also include those described in Gong et al., *Macromolecules*, Vol. 31, 1814 (1998)), the disclosure of which being totally incorporated herein by reference.

The polyimide may be for example polyimide of 3,3-bis (4-(4'-aminophenoxy)phenyl) phthalimidime with bis (trimellitimide, poly(esterimide), poly(etherimide) or any of the suitable polyimides selected from the list contained in Polymer Handbook, Fourth Edition, J. Brandrup, E. H. Immergut, and E. A. Grulke, Editors, John Wiley & Sons, 1999, pp. 241, the disclosure of which is totally incorporated herein by reference.

The polyester may be for example polyarylate of terephthalic acid, poly(bisphenol A terephthalate), poly(butylene adipate), poly(butylene isophthalate), poly(butylene naphthalate), poly(butylene sebacate), poly(decamethylene sebacate), poly(triethyleneoxysebacate), poly(butylene succinate), poly(ethylene terephthalate), poly(ethylene naphthalate), poly(lactic acid), poly (ϵ-caprolactone), or any of the suitable polyesters selected from the list contained in Polymer Handbook, Fourth Edition, J. Brandrup, E. H. Immergut, and E. A. Grulke, Editors, John Wiley & Sons, 1999, pp. 221–224, the disclosure of which is totally incorporated herein by reference. Copolymers of these polyesters may also be used, e.g., poly(butylene succinate-co-butylene adipate) or poly (butylene succinate-co-ϵ-caprolactone). Suitable polyesters also include those described in Gibson et al., *J. Am. Chem. Soc.*, Vol. 117, 852 (1995), the disclosure of which being totally incorporated herein by reference.

The linear molecules can be a homopolymer or a copolymer of two or more different repeat units using the materials described herein. For example, a linear copolymer may be made of two or more different polycarbonates. Another linear copolymer can be poly(imide-carbonate).

Optional end groups for the linear molecules may be for example triphenyl propionate or any triarylalkanoate which may be chemically attached to the linear molecules after threading of the cyclic molecules by the linear molecules.

The extent of threading can be determined by methods such as Gel Permeation Chromatography. The present inventors employed deductive reasoning to conclude that threading occurred in the Examples described later. Since cyclic molecules generally are of low molecular weight, if threading had not taken place, addition of the low molecular weight cyclic molecules to the linear molecules in the charge transport layer would have in fact increased the abrasion of the charge transport layer. The fact that there was a reduction in the rate of abrasion with addition of the cyclic molecules shows that threading indeed occurred.

Since the extent of threading of the linear molecules through the cyclic molecules is not easy to measure, the values stated herein for the weight of the rotaxane material in the charge transport layer are based on the total weight of the cyclic molecules and linear molecules, regardless of the extent of threading. Similarly, the values stated herein for the content of the cyclic molecules and the linear molecules in the rotaxane material are based on the weight of the cyclic molecules and linear molecules, regardless of the extent of threading.

The rotaxane material is present in an amount ranging for example from about 40% to about 90% by weight, preferably from about 50% to about 80% by weight, based on the weight of the charge transport layer, the balance being for instance the weight of the charge transport material.

The content by weight of the cyclic molecules in the rotaxane material may range for example from about 5% to about 80% and the content by weight of the linear molecules in the rotaxane material may range for example from about 95% to about 20% based on the weight of the rotaxane material. In embodiments, the content by weight of the cyclic molecules in the rotaxane material ranges from about 10% to about 60% and the content by weight of the linear molecules in the rotaxane material ranges from about 90% to about 40% based on the weight of the rotaxane material.

The rotaxane can be formed by any suitable technique. In the statistical approach, the interaction between cyclic and linear species is weakly attractive, negligible or perhaps repulsive. The equilibrium for threading is thus primarily entropically controlled and is subject to application of Le Chatelier's principle by use of an excess of macrocycle. The alternative approach is called template or directed threading, and it involves an attractive interaction between the linear species and the macrocycle, such as metal chelation, charge transfer interactions or the like. Hence, the equilibrium is enthalpically driven. Charge transport layer solutions can be prepared for example by dissolving 40% by weight of N,N'-diphenyl-N,N'-bis(3-methylphenyl)-(1,1'-biphenyl)-4, 4'-diamine, 30 to 55% by weight of a linear polycarbonate and 30 to 5% by weight of the cyclic polycarbonate in dichloromethane. The solution was coated onto an organic photoconducting layer. The charge transport layer thus obtained can be dried to provide a final thickness of about 15 to 30 micrometers.

In addition to the rotaxane material, any other suitable inactive resin binder may be employed in the charge transport layer. Typical inactive resin binders soluble in methylene chloride include polycarbonate resin, polyvinylcarbazole, polyester, polyarylate, polystyrene, polyacrylate, polyether, polysulfone, and the like. Molecular weights can vary from about 20,000 to about 1,500,000.

Any suitable technique may be utilized to apply the charge transport layer and the charge generating layer. Typical application techniques include spraying, dip coating, roll coating, wire wound rod coating, and the like. Drying of the deposited coating may be effected by any suitable conventional technique such as oven drying, infrared radiation drying, air drying and the like. Generally, the thickness of the charge generating layer ranges from about 0.1 micrometer to about 3 micrometers and the thickness of the transport layer is between about 5 micrometers to about 100 micrometers, but thicknesses outside these ranges can also be used. In general, the ratio of the thickness of the charge transport layer to the charge generating layer is preferably maintained from about 2:1 to 200:1 and in some instances as great as 400:1.

The benefits of the present invention will now be discussed. In a conventional charge transport layer containing linear molecules as the polymer binder, mechanical abrasion depends on the cohesive energy of the linear molecules, which in turn depends on their chain flexibility and molecular motion. The cohesive energy can be considered to be the energy required to pull one linear molecule from the bulk of the linear molecules. The lower the cohesive energy of the polymer binder and the higher its flexibility, the easier it would be to abrade. In experiments performed by the present inventors, the correlation was established between the calculated cohesive energy and experimentally measured abrasive wear of four different types of linear polycarbonates. It was clearly seen that the abrasive wear depends inversely on the cohesive energy. By threading the linear molecules into cyclic molecules, the chain mobility of the linear molecules is reduced. This is expected to provide better abrasion resistance.

The flexibility and molecular motion of conventional polymer binders also may be responsible for crystallization of small molecule charge transport materials such as aryl amines. Crystallization is undesirable because in a photoreceptor, the incident (exposure) light has to be transmitted through the charge transport layer (CTL) and be absorbed by the charge generation layer (CGL) to efficiently photogenerate charge carriers. The crystallization of the charge transport layer will lead to scattering of the incident light and a reduction of the exposure light reaching the CGL. This decreases the efficiency of the photogeneration and the photosensitivity. The crystallization of the CTL can also result in reduced mechanical strength of belt photoreceptors. Molecular simulations by the present inventors have shown that in the presence of N,N'-diphenyl-N,N'-bis(3-methylphenyl)-(1,1'-biphenyl)-4,4'-diarnine (also referred herein as "TPD"), the cohesive energy of particular conventional polymer binders decreases substantially. Experiments also show that the glass transition of a linear polycarbonate is reduced by addition of TPD. Inter-chain cohesitivity is affected. The lower the cohesive energy of the polymer binder and the higher its flexibility, the faster will be the diffusion and crystallization of TPD. By threading the linear molecules into cyclic molecules, the chain mobility of the linear molecules is reduced. This is expected to provide better stability of small molecule charge transport materials against crystallization, in addition to improved abrasion resistance.

The Overcoating Layer

Embodiments in accordance with the present invention can, optionally, further include an overcoating layer or layers 8, which, if employed, are positioned over the charge generation layer or over the charge transport layer. This layer comprises organic polymers or inorganic polymers that are electrically insulating or slightly semi-conductive. Materials described herein for the anti-curl layer also may be suitable for the overcoating layer. In embodiments, the overcoating layer may have the same composition as the anti-curl layer.

Such a protective overcoating layer includes a film forming resin binder optionally doped with a charge transport material. In embodiments, there is absent any charge transport material in the overcoating layer.

Any suitable film-forming inactive resin binder can be employed in the overcoating layer of the present invention. For example, the film forming binder can be any of a number of resins, such as polycarbonates, polyarylates, polystyrene, polysulfone, polyphenylene sulfide, polyetherimide, polyphenylene vinylene, and polyacrylate. The resin binder used in the overcoating layer can be the same or different from the resin binder used in the anti-curl layer or in any charge transport layer that may be present. The binder resin should preferably have a Young's modulus greater than about $2\times10^5$ psi, a break elongation no less than 10%, and a glass transition temperature greater than about 150 degrees C. The binder may further be a blend of binders. The preferred polymeric film forming binders include MAKROLON™, a polycarbonate resin available from Farbenfabriken Bayer A. G., 4,4'-cyclohexylidene diphenyl polycarbonate, available from Mitsubishi Chemicals, high molecular weight LEXAN™ 135, available from the General Electric Company, ARDEL™ polyarylate D-100, available from Union Carbide, and polymer blends of MAKROLON™ and the copolyester VITEL™ PE-100 or VITEL™ PE-200, available from Goodyear Tire and Rubber Co.

In embodiments, a range of about 1% by weight to about 10% by weight of the overcoating layer of Vitel copolymer is preferred in blending compositions, and, more preferably, about 3% by weight to about 7% by weight. Other polymers that can be used as resins in the overcoat layer include DUREL™ polyarylate from Celanese, polycarbonate copolymers LEXAN™ 3250, LEXAN™ PPC 4501, and LEXAN™ PPC 4701 from the General Electric Company, and CALIBRE™ from Dow.

Additives may be present in the overcoating layer in the range of about 0.5 to about 40 weight percent of the overcoating layer. Preferred additives include organic and inorganic particles which can further improve the wear resistance and/or provide charge relaxation property. Preferred organic particles include Teflon powder, carbon black, and graphite particles. Preferred inorganic particles include insulating and semiconducting metal oxide particles such as silica, zinc oxide, tin oxide and the like. Another semiconducting additive is the oxidized oligomer salts as described in U.S. Pat. No. 5,853,906. The preferred oligomer salts are oxidized N, N, N', N'-tetra-p-tolyl-4,4'-biphenyldiamine salt.

In embodiments, the overcoating layer includes a rotaxane material. The rotaxane material is present in an amount ranging for example from about 60% to about 100% by weight based on the weight of the overcoating layer, the balance being other materials such as additives described herein. The rotaxane material useful for the overcoating layer is described in more detail in the section pertaining to the charge transport layer. Unless otherwise noted, the description of the rotaxane material and its use for the charge transport layer is equally applicable for the use of the rotaxane material in the overcoating layer.

The overcoating layer can be prepared by any suitable conventional technique and applied by any of a number of application methods. Typical application methods include, for example, hand coating, spray coating, web coating, dip coating and the like. Drying of the deposited coating can be effected by any suitable conventional techniques, such as oven drying, infrared radiation drying, air drying, and the like.

Overcoatings of from about 3 micrometers to about 7 micrometers are effective in preventing charge transport molecule leaching, crystallization, and charge transport layer cracking. Preferably, a layer having a thickness of from about 3 micrometers to about 5 micrometers is employed.

The Ground Strip

Ground strip 9 can comprise a film-forming binder and electrically conductive particles. Cellulose may be used to disperse the conductive particles. Any suitable electrically conductive particles can be used in the electrically conductive ground strip layer 9. The ground strip 9 can, for example, comprise materials that include those enumerated in U.S. Pat. No. 4,664,995. Typical electrically conductive particles include, but are not limited to, carbon black, graphite, copper, silver, gold, nickel, tantalum, chromium, zirconium, vanadium, niobium, indium tin oxide, and the like.

The electrically conductive particles can have any suitable shape. Typical shapes include irregular, granular, spherical, elliptical, cubic, flake, filament, and the like. Preferably, the electrically conductive particles should have a particle size less than the thickness of the electrically conductive ground strip layer to avoid an electrically conductive ground strip layer having an excessively irregular outer surface. An average particle size of less than about 10 micrometers generally avoids excessive protrusion of the electrically conductive particles at the outer surface of the dried ground strip layer and ensures relatively uniform dispersion of the particles through the matrix of the dried ground strip layer. Concentration of the conductive particles to be used in the ground strip depends on factors such as the conductivity of the specific conductive materials utilized.

In embodiments, the ground strip layer may have a thickness of from about 7 micrometers to about 42 micrometers and, preferably, from about 14 micrometers to about 27 micrometers.

The invention will now be described in detail with respect to specific preferred embodiments thereof, it being understood that these examples are intended to be illustrative only and the invention is not intended to be limited to the materials, conditions, or process parameters recited herein. All percentages and parts are by weight unless otherwise indicated.

COMPARATIVE EXAMPLE

A photoreceptor was prepared by providing a titanized MYLAR® substrate with a thickness of 75 micrometers, followed by applying thereto with a film applicator a solution of N-methyl-3-aminopropyl-trimethoxy silane (obtained from PCR Research Chemicals) in ethanol (1:20 volume ratio). This hole blocking layer, 0.1 micrometer, was dried for 5 minutes at room temperature, and then cured for 10 minutes at 110 degrees C in a forced air oven. There was then applied to the above silane layer a solution of 0.5 weight % of 49,000 polyester in a mixture of methylene chloride and 1,1,2-trichloroethane (4:1 volume ratio) with a film applicator. The layer was allowed to dry for 1 minute at room temperature and then cured for 10 minutes at 100 degrees C in a forced air oven.

A dispersion of Type V hydroxygallium phthalocyanine ("HOGaPC") was prepared by milling 0.125 gram of the HOGaPC, and 0.125 gram of polystyrene-block-polyvinylpyridine in 9.0 grams of chlorobenzene in a 30 milliliter glass bottle containing 70 grams of ⅛ inch stainless steel balls. The bottle was put on a Norton roller mill running at 300 rpm for 20 hours. The dispersion was coated on the titanized MYLAR® substrate using 1 mil film applicator to form a photogenerator layer. The formed photogenerating layer HOGaPc was dried at 135° C. for 20 minutes to a final thickness of about 0.3 micrometer.

A hole transporting layer solution was prepared by dissolving 2.33 grams of N,N'-diphenyl-N,N'-bis(3-methylphenyl)-(1,1'-biphenyl)-4,4'-diamine and 3.5 grams of a linear polycarbonate MAKROLON® 5705 in 35 grams of dichloromethane. The solution was coated onto the HOGaPc generator layer using a 10 mil film applicator. The charge transporting layer thus obtained was dried at 135° C. for 20 minutes to provide a final thickness of about 25 micrometers. This was used as a control sample for comparison.

EXAMPLES 1–3

(a) Preparation of Cyclic Polycarbonate

The reaction was conducted in a one liter Morton flask equipped with a mechanical stirrer, a condenser, septum, addition funnel and heating mantle. To this flask were added: 200 ml $CH_2Cl_2$, 7 ml of deionized water, 3 ml of 9.75 Molar NaOH solution, 2.4 ml of triethyl amine. Stirring and gentle reflux were begun. Bisphenol A bischloroformate, from VanDeMark Chemical Co. of Lockport, N.Y., previously recrystallized from hexane and about 70.5 grams were dissolved into 200 ml methylene chloride and added to the above flask by means of a peristaltic pump over the course of forty minutes. Concurrently about 59 ml of about 9.75 Molar sodium hydroxide solution was added by means of the addition funnel and about 2.4 mls of triethyl amine added by means of a syringe pump. After forty minutes the reaction was terminated by the addition of 200 ml of 1M HCl solution. The reaction mixture was transferred to a separatory funnel where the organic and aqueous layers separated and the organic layer was washed with deionized water (3×) and once with saturated NaCl solution, then dried over magnesium sulfate. The methylene chloride was removed on a rotovap and the resulting solid was mixed with several volumes of acetone. Filtration of the acetone extract and subsequent removal of the acetone yielded 24 g of a mixture of different ring sizes of cyclic oligomers of 4,4'-isopropylidenebisphenol carbonate. Confirmation of the product structure was determined by GPC and NMR. GPC analysis showed a cluster of about 6 discernable peaks with the weight average molecular weight for the entire group of about 1,200 Daltons relative to polystyrene. NMR analysis was consistent with a cyclic for the mixture 4,4'-isopropylidenebisphenol carbonate structure.

(b) Preparation of Photoreceptors

The procedures of the Comparative Example were used to fabricate three inventive photoreceptors with the exception that different amounts of the cyclic polycarbonate prepared above in (a) were added to the linear polycarbonate. Example 1 employed 5% by weight cyclic polycarbonate and 95% by weight linear polycarbonate. A hole transporting layer solution was prepared by dissolving 2.33 grams of N,N'-diphenyl-N,N'-bis(3-methylphenyl)-(1,1'-biphenyl)-4,4'-diamine, 3.325 grams of a linear polycarbonate Makrolon 5705 and 0.175 grams of the cyclic polycarbonate in 35 grams of dichloromethane. The solution was coated onto the HOGaPc generator layer using a 10 mil film applicator. The charge transporting layer thus obtained was dried at 135° C. for 20 minutes to provide a final thickness of about 25 micrometers. Example 2 employed 10% by weight cyclic polycarbonate and 90% by weight linear polycarbonate. A hole transporting layer solution was prepared by dissolving 2.33 grams of N,N'-diphenyl-N,N'-bis(3-methylphenyl)-(1,1'-biphenyl)-4,4'-diamine, 3.15 grams of a linear polycarbonate Makrolon 5705 and 0.35 grams of the cyclic polycarbonate in 35 grams of dichloromethane. The solution was coated onto the HOGaPc generator layer using a 10 mil film applicator. The charge transporting layer thus obtained was dried at 135° C. for 20 minutes to provide a final thickness of about 25 micrometers. Example 3 employed 20% by weight cyclic polycarbonate and 80% by weight linear polycarbonate. A hole transporting layer solution was prepared by dissolving 2.33 grams of N,N'-diphenyl-N,N'-bis(3-methylphenyl)-(1,1'-biphenyl)-4,4'-diamine, 2.8 grams of a linear polycarbonate Makrolon 5705 and 0.70 grams of the cyclic polycarbonate in 35 grams of dichloromethane. The solution was coated onto the HOGaPc generator layer using a 10 mil film applicator. The charge transporting layer thus obtained was dried at 135° C. for 20 minutes to provide a final thickness of about 25 micrometers. The formulations of the charge transport layers of the various photoreceptors are shown in Table 1.

TABLE 1

Formulations of charge transport layers

| Examples | % Cyclic Polycarbonate | TPD g | Linear Polycarbonate g | Cyclic Poly-car-bonate g | Dichloro-methane g |
|---|---|---|---|---|---|
| Comp. Ex. | 0 | 2.33 | 3.5 | | 35 |
| Ex. 1 | 5 | 2.33 | 3.325 | 0.175 | 35 |
| Ex. 2 | 10 | 2.33 | 3.15 | 0.35 | 35 |
| Ex. 3 | 20 | 2.33 | 2.8 | 0.7 | 35 |

(c) Testing and Evaluation of Photoreceptors

The abrasion resistance of all the photoreceptors was determined by using a Taber abrader. The Taber abrader was used for testing the abrasion loss of paper (TAPPI test method T-476) and was in an environmentally controlled room at 22 degrees C and 50% relative humidity. Each sample was glued onto a specimen mounting sheet (10 cm×10 cm) so that the top surface with the charge transport layer can be tested for abrasion resistance. Each sample was mounted on a horizontal turntable with a center clamp, which rotated at a speed of 70 rpm. Two weighted parallel arms, each carrying a special abrasive wheel, freely rotating on a ball-bearing spindle and each resting on the sample surface with a known weight were used. In this test, parallel arms with a weight of 500 g and a counter weight of 125 g on the other end of the abrading arm were used. A pair of suction nozzles was positioned slightly above the sample surface to remove the worn debris during the abrasion test. The specimen sheet with the sample was weighed before and after the abrasion test (10,000 cycles). The abrasion weight loss was normalized and expressed as abrasion rate per cycle for comparison. The photoreceptor of the Comparative Example was used as the reference for comparison. A comparison of the relative abrasion weight loss and improvement in the abrasion resistance was made with different loadings of the cyclic polycarbonate in the charge transport layer. The results of the abrasion resistance tests are shown in Table 2

TABLE 2

Effect of cyclic polycarbonate on abrasion of charge transport layer

| Examples | % Cyclic polycarbonate | % Linear Polycarbonate | Abrasion Rate μg/cycle |
|---|---|---|---|
| Comp. Ex. | 0 | 100 | 1.5 |
| Ex. 1 | 5 | 95 | 1.2 |
| Ex. 2 | 10 | 90 | 1.05 |
| Ex. 3 | 20 | 80 | 0.86 |

This Table 2 shows that Examples 1, 2 and 3 with the cyclic polycarbonate exhibit reduced wear of the charge transport layer compared to the comparative example with no cyclic polycarbonate. In the case of Example 3, with 20% cyclic polycarbonate, the abrasion rate is reduced by nearly half, from 1.5 μg/cycle to 0.86 μg/cycle.

The xerographic electrical properties of the various photoreceptors (Comparative Example and Examples 1–3) was determined by known means, including as indicated herein electrostatically charging the surfaces thereof with a corona discharge source until the surface potentials, as measured by a capacitively coupled probe attached to an electrometer, attained an initial value $V_0$ of about −800 volts. After resting for 0.5 second in the dark, the charged photoreceptors attained a surface potential of $V_{ddp}$ (dark development potential). Each photoreceptor was then exposed to light from a filtered Xenon lamp, thereby inducing a photodischarge which resulted in a reduction of surface potential to a $V_{bg}$ value (background potential). The percent of photodischarge was calculated as $100\times(V_{ddp}-V_{bg})V_{ddp}$. The desired wavelength and energy of the exposed light were determined by the type of filters placed in front of the lamp. The monochromatic light photosensitivity was determined using a narrow band-pass filter. The xerographic properties of the photoreceptors are found in Table 3.

TABLE 3

Effect of cyclic polycarbonate on xerographic properties of photoreceptor

| Examples | % Cyclic Poly-car-bonate | Dark Decay (voltage/sec) | E½ (ergs/cm²) | Photo-sensitivity V-cm²/ergs | Residual Voltage (Volts) |
|---|---|---|---|---|---|
| Comp. Ex. | 0 | 19 | 1.84 | 241 | 4 |
| Ex. 1 | 5 | 20 | 1.85 | 235 | 7 |
| Ex. 2 | 10 | 18 | 1.87 | 230 | 7 |
| Ex. 3 | 20 | 25 | 1.82 | 230 | 8 |

The results of Table 3 indicate that all the photoreceptors of Examples 1–3 exhibit excellent xerographic properties, namely, high photosensitivity and low residual voltage. similar to the Comparative Example. The results of Table 3 in conjunction with the results of Table 2 indicate that an improvement in abrasion resistance was obtained without any degradation in the xerographic properties.

Other modifications of the present invention may occur to those skilled in the art based upon a reading of the present disclosure and these modifications are intended to be included within the scope of the present invention.

We claim:

1. A photoreceptor comprising:

(a) a substrate;

(b) a charge generating layer; and (c) a charge transport layer including a charge transport material and a rotaxane material.

2. The photoreceptor of claim 1, wherein the charge transport material is an aryl amine.

3. The photoreceptor of claim 1, wherein the cyclic molecules of the rotaxane material are selected from the group consisting of a cyclic polycarbonate, a crown ether, a cyclodextrin, and a cyclic polyester.

4. The photoreceptor of claim 1, wherein the linear molecules of the rotaxane material are a homopolymer selected from the group consisting of a linear polycarbonate, a polyamide, a polyurethane, a polyimide, and a polyester.

5. The photoreceptor of claim 1, wherein the linear molecules of the rotaxane material is a copolymer.

6. The photoreceptor of claim 1, wherein the rotaxane material is present in an amount ranging from about 40% to about 90% by weight based on the weight of the charge transport layer.

7. The photoreceptor of claim 1, wherein the rotaxane material is present in an amount ranging from about 50% to about 80% by weight based on the weight of the charge transport layer.

8. The photoreceptor of claim 1, wherein the content by weight of the cyclic molecules in the rotaxane material ranges from about 5% to about 80% and the content by weight of the linear molecules in the rotaxane material ranges from about 95% to about 20% based on the weight of the rotaxane material.

9. The photoreceptor of claim 1, wherein the content by weight of the cyclic molecules in the rotaxane material ranges from about 10% to about 60% and the content by weight of the linear molecules in the rotaxane material ranges from about 90% to about 40% based on the weight of the rotaxane material.

10. A composition including a charge transport material and a rotaxane material.

11. A photoreceptor comprising:

(a) an anti-curl layer including a rotaxane material;

(b) a substrate; and (c) an imaging layer.

12. A photoreceptor comprising:

(a) a substrate;

(b) an imaging layer; and (c) an overcoating layer including a rotaxane material.

* * * * *